United States Patent [19]

Schnyder

[11] Patent Number: 4,470,283

[45] Date of Patent: Sep. 11, 1984

[54] ROLL STAND CONTAINING WORK ROLLS

[75] Inventor: Eugen Schnyder, Affoltern a. Albis, Switzerland

[73] Assignee: Escher Wyss Aktiengesellschaft, Zürich, Switzerland

[21] Appl. No.: 353,631

[22] Filed: Mar. 1, 1982

[30] Foreign Application Priority Data

Mar. 16, 1981 [CH] Switzerland ..... 1756/81

[51] Int. Cl.[3] ..... B21B 29/00; B21B 31/14

[52] U.S. Cl. ..... 72/241; 29/113 AD; 29/116 AD; 72/238; 72/245; 100/162 B

[58] Field of Search ..... 72/241, 238, 239, 242, 72/243, 245; 29/113 AD, 116 AD; 100/162 B

[56] References Cited

U.S. PATENT DOCUMENTS

| | | | |
|---|---|---|---|
| Re. 18,992 | 11/1933 | Iversen | 72/243 |
| 1,905,129 | 4/1933 | Biggert, Jr. et al. | 72/243 |
| 2,140,929 | 12/1938 | Talbot | 72/243 X |
| 3,376,724 | 4/1968 | Wolfendale et al. | 72/239 |
| 3,733,877 | 5/1973 | Field | 72/239 |
| 4,059,002 | 11/1977 | Rommen et al. | 72/242 X |
| 4,059,976 | 11/1977 | Christ et al. | 29/116 AD X |
| 4,218,905 | 8/1980 | Lehmann et al. | 72/241 X |

FOREIGN PATENT DOCUMENTS

| | | | |
|---|---|---|---|
| 384010 | 10/1923 | Fed. Rep. of Germany . | |
| 2750040 | 5/1979 | Fed. Rep. of Germany | 72/238 |
| 576128 | 10/1977 | U.S.S.R. | 72/238 |

*Primary Examiner*—Francis S. Husar
*Assistant Examiner*—Steven B. Katz
*Attorney, Agent, or Firm*—Werner W. Kleeman

[57] ABSTRACT

A roll stand arrangement contains work rolls and back-up or support rolls, the work rolls being laterally supported by hydrostatic support ledges. Within each upright or support stand of the roll stand arrangement there is provided a guide frame which is guided within a window of the related support stand together with mounting elements for the back-up or support rolls. Within the guide frame there are guided the mounting elements of the work rolls in slide elements. There are simultaneously pivotably supported in the slide elements the shaft or bearing journals of the support ledges.

13 Claims, 4 Drawing Figures

ROLL STAND CONTAINING WORK ROLLS

BACKGROUND OF THE INVENTION

The present invention relates to a new and improved construction of rolling mill and, in particular, concerns a roll stand or roll stand arrangement containing work rolls.

Generally speaking, the roll stand arrangement containing work rolls of the present development has such work rolls supported, with respect to the pressing force, at back-up or support rolls, and there are provided lateral hydrostatic support ledges or ledge members. Both the back-up rolls and the work rolls are provided with mounting elements which are guided in windows of the upright support stands or frames of the roll stand arrangement.

A roll stand arrangement of the aforementioned type is known to the art from U.S. Pat. No. 4,218,905, granted Aug. 26, 1980.

SUMMARY OF THE INVENTION

It is a primary object of the present invention to provide a new and improved construction of a roll stand constituting an improvement upon the heretofore known roll stand of a rolling mill, and specifically with the objective of facilitating the dismantling of the work rolls and also the lateral hydrostatic support ledges, and thus, appreciably increasing the productivity or output capacity of the roll stand during operation.

Still a further significant object of the present invention is directed to a new and improved construction of roll stand arrangement which is relatively simple in design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the roll stand arrangement of the present development is manifested by the features that there is provided a respective guide frame located in each support stand or frame of the roll stand arrangement. These guide frames ae each guided in a window of a related support stand or frame and themselves each possess a window in which there are guided the mounting elements of the work rolls. The ends of the lateral support ledges or ledge members are simultaneously pivotably supported at the region of each related guide frame.

The guide frames provided according to the teachings of the invention enable conjointly dismantling both of the work rolls in conjunction with their support ledges as a unit or block. At the same time there also exists the possibility of only dismantling the work rolls and to allow the guide frames together with the support ledges to remain in the support stands or frames of the roll stand arrangement.

The ends of the lateral support ledges or equivalent structure can be preferably mounted in slide elements which are guided in the guide frames in a direction essentially parallel to the pressing or working direction. These slide elements can possess guide surfaces for the mounting elements of the work rolls and can be rigidly connected with these mounted elements. During operation, with such roll stand design the support ledges can follow the movements of their related work rolls. On the other hand, the work rolls can be dismantled without any hindrance out of the roll stand arrangement upon releasing the connection with the slide elements.

The support ledges preferably can be pivoted out of the region of the contour or sectional shape of the mounting elements of the work rolls.

The slide elements also each can have a substantially T-shaped cross-sectional configuration, and the flange of such cross-section shape confronts the mounting element of the related work roll, and furthermore possesses a guide surface for the mounting element. Additionally, the leg portion of such T-shaped slide element is guided in a groove of the guide frame. The connection of the flange or flange portion of the slide element with the mounting element of the related work roll can be accomplished by a groove which extends essentially parallel to the axial direction of the work roll and, further, by means of a part of the flange portion which engages with the groove. Consequently, there is rendered possible a simple dismantling or knock-down of the work rolls in that, in each instance, there is possible disassembly of the work rolls in the direction of the groove.

The ends of the support ledges which are pivotably mounted in the slide elements can extend through elongate openings or holes provided in the guide frames. Consequently, there is obtained the requisite mobility of the slide elements in conjunction with the mounting elements of the work rolls in relation to the guide frames.

The back-up or support rolls can be constituted by conventional controlled deflection rolls possessing a stationary roll support or beam and a substantially tubular-shaped roll shell which is rotatable about the stationary roll support.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
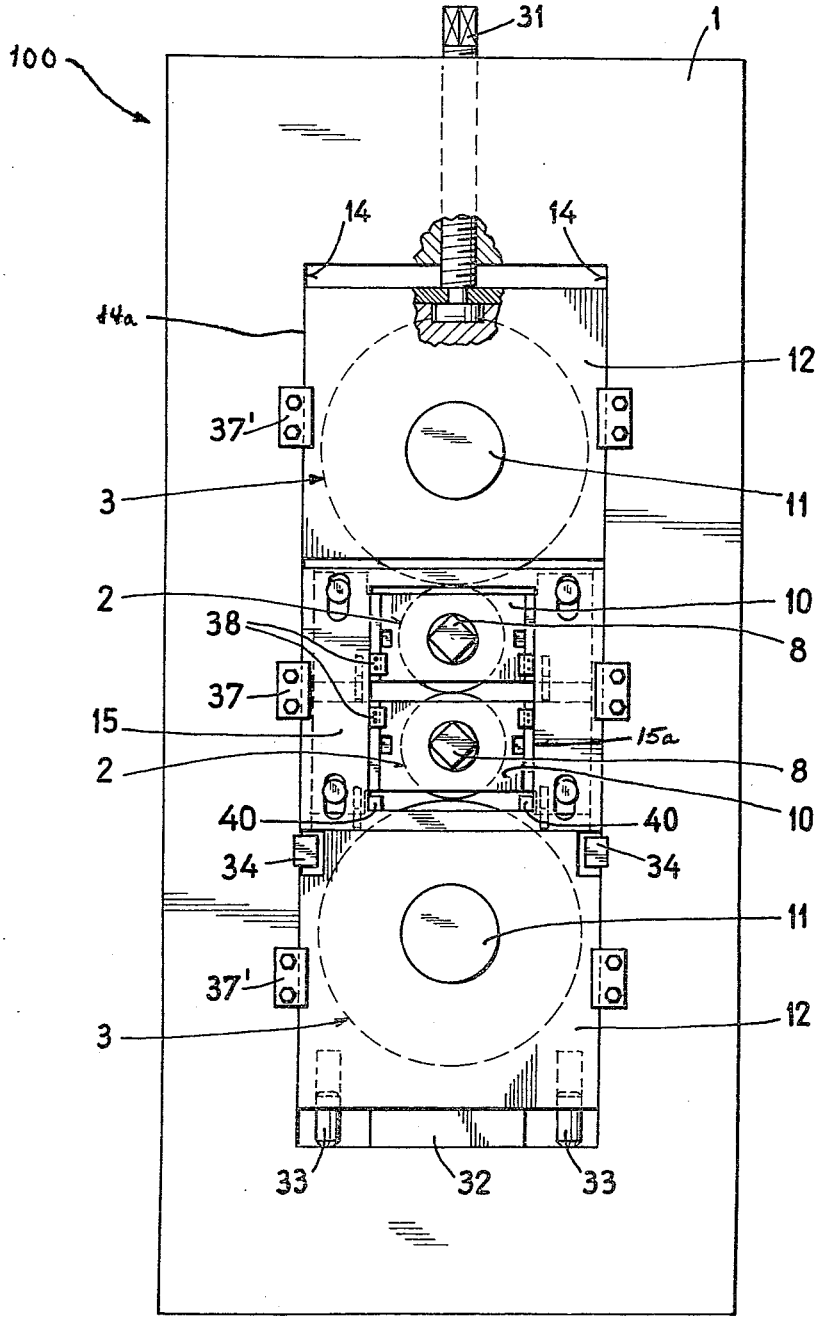
FIG. 1 is a side view, partially in section, of a roll stand arrangement constructed according to the invention and containing two work rolls and two back-up or support rolls.

Describing now the drawings, it is to be understood that only enough of the construction of the roll stand arrangement of the present development has been shown to enable those skilled in the art to readily understand the underlying principles and concepts of the present development, while simplifying the illustration of the drawings. The roll stand arrangement of a rolling mill schematically illustrated in the drawings, and generally indicated by reference character 100, will be seen to contain two spaced upright support frames or stands 1 in which there are mounted two work rolls 2 and two back-up or support rolls 3. As the back-up rolls 3 there are employed, in the exemplary embodiment under discussion, so-called controlled deflection rolls which, as is quite well known for such type of rolls, contain a stationary roll support or beam 4 and a substantially tubular-shaped roll shell or jacket 5 which is rotatable about the stationary roll support 4, as best seen by referring to FIG. 4. Such type of controlled deflection roll has been disclosed, for instance, in U.S. Pat. No. 3,802,044, granted Apr. 9, 1974. However, it is to be specifically understood that also other known constructions of such type of rolls, or even solid rolls, can be employed as the back-up or support rolls 3.

With the illustrated exemplary construction of back-up rolls 3 there are guided within bores 6 at the roll support or beam 4 of each roll 3 hydrostatic support or pressure pistons 7 which exert a pressure upon the related tubular-shaped roll shell 5, and thus, simultaneously produce the pressing force. Rolls suitable for this purpose have also been disclosed in U.S. Pat. No. 3,885,283, granted May 27, 1975.

Figure 2:
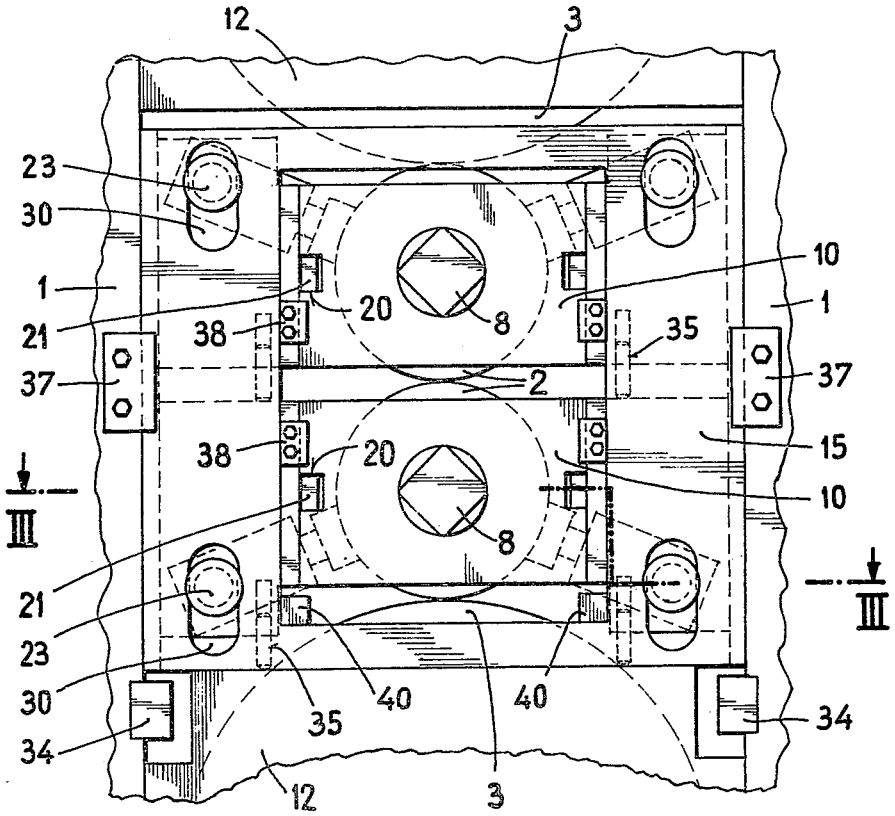
FIG. 2 illustrates a detail of the arrangement of FIG. 1 on an enlarged scale.
Figure 3:
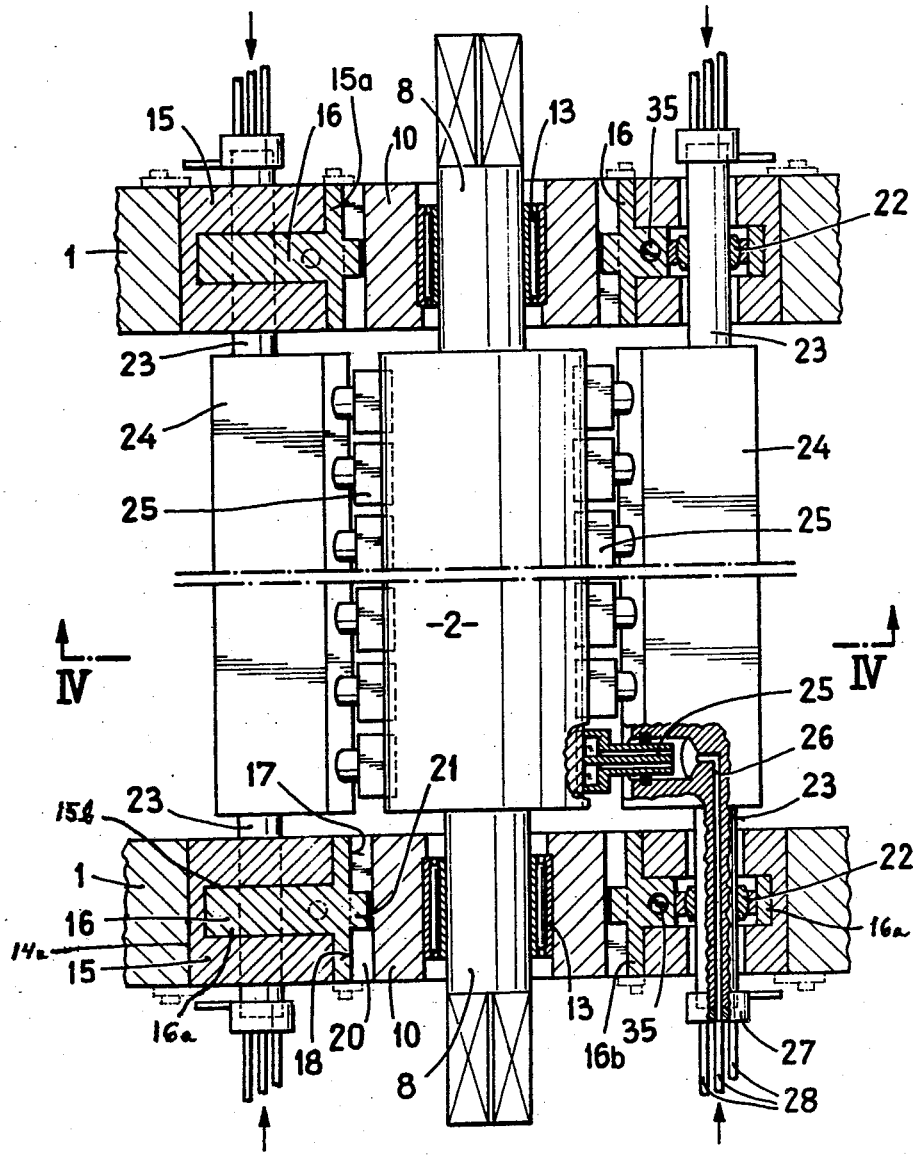
FIG. 3 is a sectional view of the arrangement of FIG. 2, taken substantially along the section line III—III thereof.

As will be further evident by referring to the drawings, especially FIGS. 1 to 3, the bearing or shaft journals 8 of the work rolls 2 are rotatably mounted in mounting elements 10. The bearing or shaft journals 11 of the back-up rolls 3 are supported in mounting elements 12.

As best seen by specifically referring to FIG. 3, the bearing or shaft journals 8 of the work rolls 2 are mounted, for instance, in needle bearings 13 in the mounting elements 10. Here also, it is to be expressly understood however, that also other types of bearing or mounting arrangements are possible, such as slide bearings.

As will be further evident from the drawings, particularly by reverting to FIG. 1, the mounting elements 12 of the back-up rolls 3 are guided at lateral guide surfaces 14 formed at openings **14*a* defining windows of the upright support frames or stands 1. The mounting elements 10 of the work rolls 2 are located, in turn, in guide frames 15, wherein a respective one of each of the guide frames 15 is guided between the guide surfaces 14 of the related upright support frame or stand 1**.

As best seen by inspecting FIG. 3, in each window-like guide frame 15 there are guided four slide elements 16 possessing a substantially T-shaped cross-sectional configuration. In each instance two slide elements 16 are operatively associated with a mounting element 10 of one of the work rolls 2. Each slide element 16 possesses a substantially planar or flat guide surface 17 which coacts with a substantially planar or flat guide surface 18 of the related mounting element 10. As will be evident by inspecting FIGS. 2 and 3, grooves 20 are formed in the surfaces 18 of the mounting elements 10. Engaging into these grooves 20 are projections or protuberances 21 of the slide elements 16. The grooves 20 or equivalent structure extend in the direction of the lengthwise axis of the rolls 2 and 3, so that the mounting elements 10 together with the work rolls 2 can be conveniently displaced out of the roll stand arrangement 100.

As also will be best recognized by referring to FIGS. 2 and 3, at the leg members or legs **16*a* of the T-shaped cross-section of each slide element 16 there are pivotably mounted in bearings 22 the bearing or shaft journals 23 of support ledges or ledge members 24. These support ledges 24 are provided in conventional manner with hydrostatic support or pressure elements 25. As to the construction of these support ledges or ledge members 24 together with their support elements 25 reference may be made to the previously mentioned U.S. Pat. No. 4,218,905. The leg member 16*a* of each T-shaped slide element is seated in a leg receiving groove 15*b* of the guide frame 15, whereas the flange portion 16*b* of such slide element 16 possesses the aforementioned guide surface 17 and the flange part defining the projection or protuberance 21**.

The bearing or shaft journals 23 of the support ledges 24 and their support elements 25 are provided with bores or channels 26 or equivalent structure for the throughflow of a suitable pressurized fluid medium, for instance hydraulic oil. These bores 26 can be connected by couplings 27 or the like with infeed lines or conduits 28. As clearly shown in FIG. 2, each guide frame 15 is provided at the region of the bearing or shaft journals 23 with elongate openings or holes 30 which enable a vertical mobility of the support or guide ledges 24 together with the slide elements 16 and the work rolls 2 in relation to the guide frames 15 which contain the openings **15*a* defining windows for receiving the related mounting plates 10**.

For assembly and adjustment purposes the illustrated embodiment of roll stand arrangement 100 is also equipped with threaded spindles 31 or equivalent adjustment facilties, each such threaded spindle 31 operatively engaging with a related mounting element 12 of the upper back-up or support roll 3. Below the mounting elements 12 of the lower back-up rolls 3 there are arranged distance or spacer blocks 32, also simply referred to as spacer elements or spacers. Additionally, the mounting elements 12 of the lower back-up roll 3 are provided with hydraulic displacement or lift pistons 33 or equivalent structure.

Below the guide frames 15 there are arranged substantially horizontally extending rail members or rails 34, along which there can be pulled both of the guide frames 15 out of the roll stand arrangement 100. Additionally, and as particularly well seen by reverting to FIG. 2, also the mounting elements 10 of the work rolls 2 are provided with hydraulic displacement or lift pistons 35 or equivalent structure.

For the removal of the mounting elements 10 out of the window-like guide frame 15 there are mounted rail members or rails 40 in the guide frames 15. These rail members 40, just as is the case for the rail members 34, extend from one support stand 1 to the other and then, if desired, also protrude past the same.

To positionally fix or secure the mounting elements 10 and their related guide frame 15 in the axial direction of the rolls 2 and 3 in the work position there are provided bracket elements or plates 37 and 38 or equivalent structure. Further bracket elements or plates 37' analogously fix or secure the mounting plates 12 of the back-up rolls 3.

During operation, the rolls 2 and 3 together with their appertaining parts are located in the illustrated position, and between both of the work rolls 2 there is formed a not particularly referenced work gap or nip through which there is drawn or otherwise passed the material which is to be rolled, in the present case assumed to be an aluminum foil or sheet.

If, for instance, the work rolls 2 are to be dismantled together with the support ledges 24 and support elements 25, then with the aid of the displacement or lift pistons 33 the lower spacers 32 of the mounting elements 12 can be removed, whereafter the lower mounting elements 12 can be lowered into the support frames or stands 1. As a result, the guide frames 15 shift downwardly up to the location of the rail members 34 and come into contact therewith. When the upper mounting elements 12 are raised in conjunction with the upper rolls 2 by the action of the threaded spindles 31 or equivalent structure, then after removing the bracket elements or plates 37 the guide frames 15 can be retracted together with the work rolls 2 and in conjunction with the lateral support ledges 24 and support elements 25 while riding upon the rail members 34.

Now if it is intended to dismantle only the work rolls 2, then the guide frames 15 remain in their assembled position, and now only the brackets or plates 38 of the mounting elements 10 of the work rolls 2 are released or disconnected. Thereafter, both of the rolls 2 together with their mounting elements 10 can be drawn out of the roll stand 100 in their axial direction. To facilitate this work there can be provided between the guide frames 15 and within their window-like openings 15*a* the rail members or tracks 40, upon which can slide the lower mounting elements 10. An assembly or re-mounting of the rolls 2 can be accomplished in the reverse direction. During the disassembly work as well as during the assembly or re-mounting work there can be placed not particularly illustrated spacer elements or distance holders between the mounting elements 10.

Figure 4:
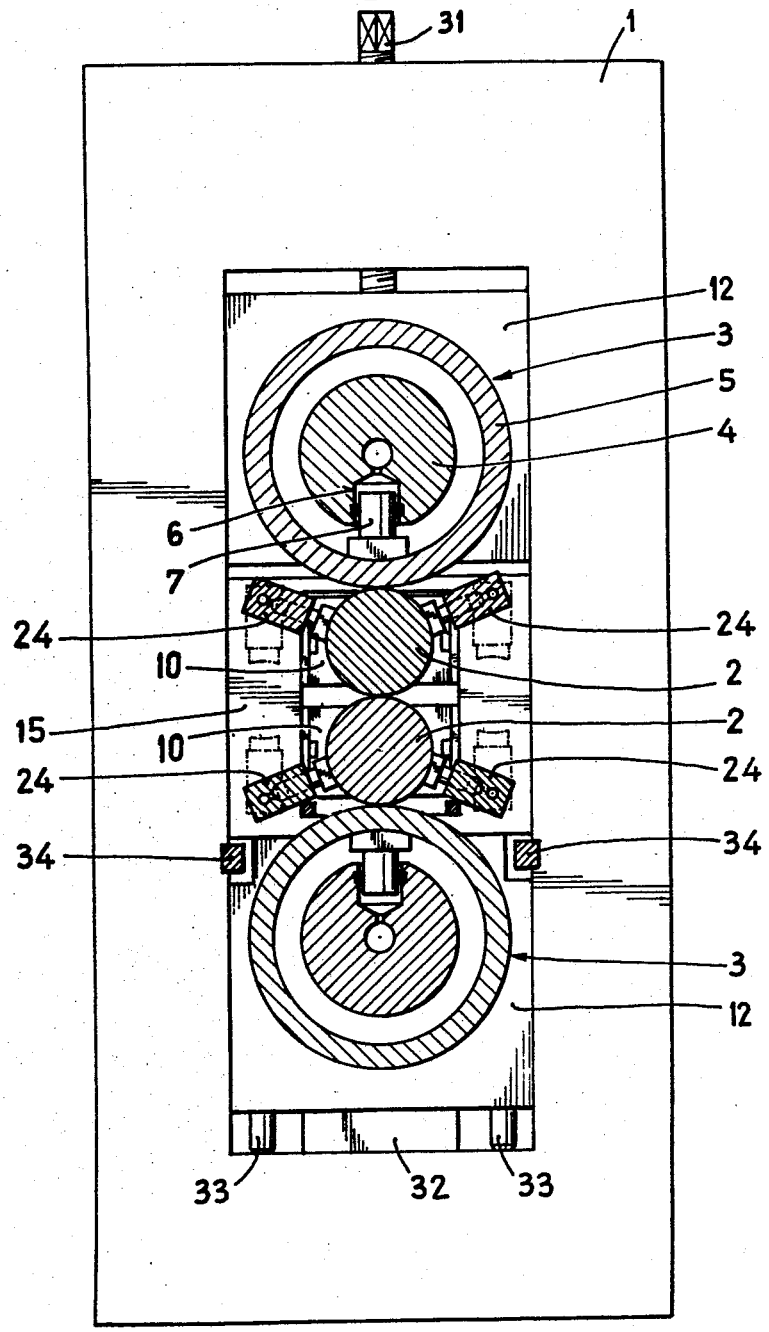
FIG. 4 is a sectional view of the arrangement of FIG. 3, taken substantially along the section line IV—IV thereof.

As will be clearly seen by referring to FIG. 4, during the dismantling of the rolls 2 together with their mounting elements 10 the support ledges 24 can be pivoted into the broken line illustrated positions, so that they move completely out of the region of the profile or contour of the mounting elements 10.

It should be understood that the slide elements 16 can also possess a different configuration than the preferred shape containing a substantially T-shaped cross-sectional configuration. Thus, there can be also employed slide elements having a simple rectangular cross-sectional configuration.

By virtue of the arrangement of the bores or channels 26 in the bearing or shaft journals 23 of the support ledges 24 there can be realized in a most simple manner a free pivoting of the support ledges 24 and their support elements 25, without having to take in to particular consideration external lines or conduits. Additionally, by virtue of the couplings or connection elements 27 there is rendered possible a simpler and more rapid connection and disconnection of the lines from externally of the roll stand arrangement 100.

While there are shown and described present preferred embodiments of the invention, it is to be distinctly understood that the invention is not limited thereto, but may be otherwise variously embodied and practiced within the scope of the following claims.

Accordingly, what I claim is:

1. A roll stand arrangement comprising:

a pair of support stands each containing means defining a respective window;

work rolls;

back-up rolls supporting the work rolls with respect to a pressing force exerted in a predetermined pressing direction by the roll stand arrangement;

lateral hydrostatic support ledges engaging the work rolls;

mounting elements supporting the back-up rolls and the work rolls;

said mounting elements of the back-up rolls being guidably mounted in said windows of said support stands;

a respective guide frame located in each support stand;

each said guide frame being guidably mounted in the window of the related support stand;

each said guide frame possessing a window in which there are guided the mounting elements of the work rolls; and means pivotably supporting opposite ends of the lateral support ledges at the region of the guide frames.

2. The roll stand arrangement as defined in claim 1, wherein:

said pivotably supporting means comprise slide elements in which there are mounted the ends of the lateral support ledges;

said slide elements being guided within the guide frames essentially parallel to said pressing direction by the guide frames; and said slide elements being provided with guide surfaces for the mounting elements of the work rolls and being structured to be rigidly connectable with these mounting elements.

3. The roll stand arrangement as defined in claim 1 or 2, wherein:

said pivotably supporting means mount said support ledges so as to be pivotable out of the region of the profile of the mounting elements of the work rolls.

4. The roll stand arrangement as defined in claim 3, wherein:

the slide elements each possess a substantially T-shaped cross-sectional configuration containing a flange portion and a leg portion;

each flange portion confronting the related mounting element and possessing a guide surface for said related mounting element;

each guide frame having a leg receiving groove; and the leg portion being guided in said leg receiving groove of the related guide frame.

5. The roll stand arrangement as defined in claim 4, further including:

groove means for connecting the flange portion of each slide element with the mounting element of the related work roll;

said groove means extending essentially parallel to the axial direction of the work roll; and a part constituted by a portion of said flange portion engaging with said groove means.

6. The roll stand arrangement as defined in claim 2, wherein:

each of said guide frames have elongated openings;

the ends of the lateral support ledges pivotably mounted in said slide elements piercingly extending through the elongated openings of the guide frames.

7. The roll stand arrangement as defined in claim 1, wherein:

the ends of the lateral support ledges are provided with bores for the throughflow of a pressurized fluid medium;

infeed line means for supplying said pressurized fluid medium; and coupling means for connecting said bores with said infeed line means.

8. The roll stand arrangement as defined in claim 1, wherein:

at least one of said back-up rolls comprises a controlled deflection roll having a stationary roll support and a substantially tubular-shaped roll shell rotatable about said stationary roll support.

9. The roll stand arrangement as defined in claim 1, wherein:

said mounting elements of said work roll are guided in said windows of said respective guide frames such that the work rolls are capable of being extracted laterally from the roll stand as a unit with said mounting elements of the work rolls and the guide frames.

10. The roll stand arrangement as defined in claim 9, wherein:

said lateral support ledges are pivotably supported in said respective guide frames such that the lateral support ledges are capable of being laterally extracted from the roll stand as a unit with said work rolls, said work roll mounting elements and the guide frames.

11. The roll stand arrangement as defined in claim 1, wherein:

said mounting elements of said work rolls are guided in said windows of said respective guide frames such that both work rolls are capable of being laterally extracted from the guide frames as a unit with said mounting elements independently of said guide frames.

12. The roll stand arrangement as defined in claim 1, wherein:

said mounting elements of said work rolls are guided in said windows of said respective guide frames such that each work roll is capable of being laterally extracted from the guide frames as a unit with the mounting elements associated therewith independently of the guide frames.

13. A roll stand arrangement comprising:

support stands having openings defining windows;

work rolls;

back-up rolls for supporting the work rolls;

hydrostatic support ledge means cooperating with the work rolls;

mounting elements supporting the back-up rolls and the work rolls;

said mounting elements for the back-up rolls being disposed in said windows of said support stands;

a respective guide frame located in each support stand;

each said guide frame being guidably mounted in the window of the related support stand;

each said guide frame possessing an opening defining a window in which there are guided the mounting elements of the work rolls; and means for pivotably supporting opposed ends of the hydrostatic support ledge means at the guide frames.

* * * * *